United States Patent [19]

Goldenberg et al.

[11] Patent Number: 4,805,320

[45] Date of Patent: Feb. 21, 1989

[54] SHOE WITH EXCHANGEABLE HEEL

[76] Inventors: Tzvika Y. Goldenberg, 7000 Woddale Ave. South, Edina, Minn. 55435; Avraham Y. Levi, 757 Decorah La., St. Paul, Minn. 55120

[21] Appl. No.: 112,621

[22] Filed: Oct. 26, 1987

[51] Int. Cl.[4] ..... A43B 21/36; A43B 21/50

[52] U.S. Cl. ..... 36/42; 36/36 R

[58] Field of Search ..... 36/42, 36 R, 36 A, 36 B, 36/36 C

[56] References Cited

U.S. PATENT DOCUMENTS

| | | | |
|---|---|---|---|
| 2,139,885 | 12/1938 | De Gironomo | 36/42 |
| 2,224,476 | 12/1940 | Farina | 36/42 |
| 2,439,310 | 4/1948 | Mancuso | 36/42 |
| 2,767,489 | 10/1956 | Sturman | 36/42 |
| 3,782,010 | 1/1974 | Frattallone | 36/42 |
| 4,198,770 | 4/1980 | Orea Mateo | 36/42 |
| 4,400,893 | 8/1983 | Musci | 36/42 |
| 4,670,996 | 6/1987 | Dill | 36/42 |

FOREIGN PATENT DOCUMENTS

| | | | |
|---|---|---|---|
| 713290 | 8/1954 | United Kingdom | 36/42 |

*Primary Examiner*—Steven N. Meyers

*Attorney, Agent, or Firm*—Orrin M. Haugen; Thomas J. Nikolai; Frederick W. Niebuhr

[57] ABSTRACT

An article of footware comprising a shoe having a removable and replaceable heel. Attached to the sole surface of the shoe's upper is a outwardly projecting shaft which is adapted to fit into an internal bore formed in the core of the shoe's heel member. A latch mechanism is provided for inhibiting unintended separation of the heel from the upper.

7 Claims, 5 Drawing Sheets

SHOE WITH EXCHANGEABLE HEEL

BACKGROUND OF THE INVENTION

I. Field of the Invention

This invention relates generally to footware, and more particularly to the construction of a shoe where the entire heel or a portion thereof may be readily removed and exchanged with a heel or a heel portion having differing style, color, height, width or other characteristics.

II. Discussion of the Prior Art

In the field of footware, and especially women's shoes, a need exists for a more economical way to match the footware to the woman's wardrobe than having one or more pairs of shoes for each suit, dress or casual outfit that a person may own. For example, more casual ware tends to dictate a shoe with a flat heel while more formal dress dictates a shoe having a high heel. Furthermore, the shoes tend to be selected based upon color and style considerations such that they will be coordinated with the wearing apparel selected for the occasion. Obtaining and maintaining a collection of shoes to meet varying occasions can be quite expensive.

Shoe styles are also dictated by the type of activity which the wearer is planning to engage in. If considerable walking is involved, a lower, wider heel is more comfortable. However, if an evening of dining and dancing is contemplated, a higher, more narrow and more elegant shoe style is desirable.

When it is considered that to a large extent, the size, shape and color of a shoe's heel has a substantial impact on its overall appearance and comfort, an advantage exists in the ability to readily remove and exchange the heel portion of the shoe. In this way, it is not necessary to acquire a large inventory of pairs of shoes but, instead, the desired "look" and/or comfort factor can be achieved by merely substituting a new heel at a significantly lower cost.

OBJECTS

It is accordingly a principal object of the present invention to provide an improved shoe construction wherein the heel member or a portion thereof can be readily removed and replaced to effect a style change in the sole.

Another object of the invention is to provide a shoe construction in which the style, color, and other characteristics can readily be altered.

Still another object of the invention is to provide in a woman's shoe the ability to remove and replace the heel portion thereof in the matter of moments and without the use of special tools.

SUMMARY OF THE INVENTION

A shoe constructed in accordance with the present invention will have a conventional shoe upper and fastened to the sole of the upper at the location for the heel is an outwardly projecting pin or shaft surrounded at its point of attachment to the upper by a non-circular head. The heel portion of the shoe itself will normally comprise a molded plastic core wrapped or covered by decorative leather or other fabric. Extending longitudinally through the heel's core is a pin receiving bore and surrounding the bore at the top of the heel is a recess or socket dimensioned to receive the non-circular head portion projecting from the shoe upper. This allows the heel to be pushed onto the pin and the head to fit into the socket. As such, the heel is held in place on the upper and prevented from rotating about the pin.

To achieve a more positive lock, a latch mechanism is built into the heel for engaging the pin and precluding removal of the heel unless the latch is appropriately positioned with the user's thumb. When so-positioned, the heel may be pulled free from the pin without difficulty and without the use of special tools.

In accordance with another aspect of the invention, the heel itself may be segmented so that its height and width dimension can be changed by adding or removing a segment.

DESCRIPTION OF THE DRAWINGS

The foregoing objects, features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
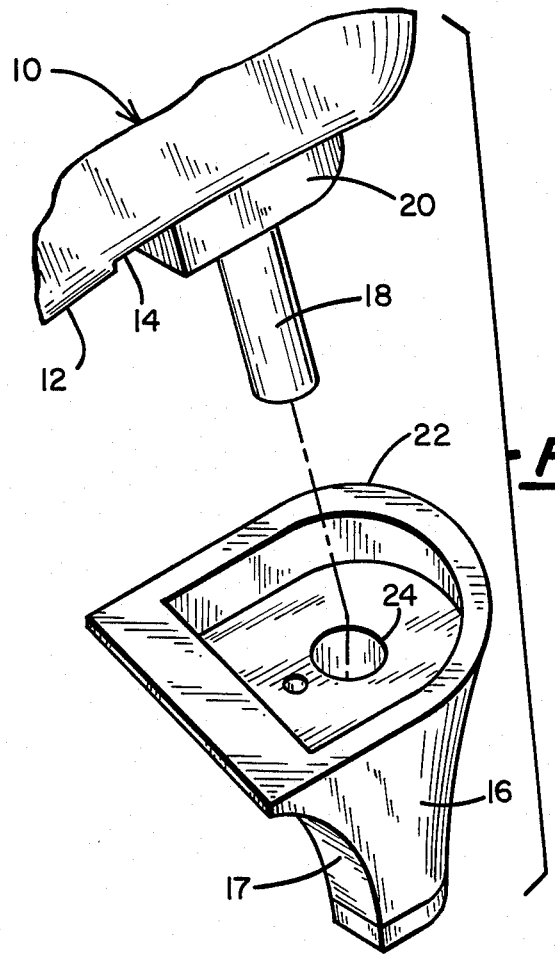
FIG. 1 is a perspective view of a woman's shoe showing the heel portion separated from the upper.

Referring to the exploded view of FIG. 1, there is identified by numeral 10 the underside of a woman's dress shoe showing a portion of the sole 12 and the surface 14 to which the shoe heel 16 is to be fastened. Suitably affixed to the surface 14 of the shoe is a pin assembly including a cylindrical shaft or pin member 18 extending outwardly from a non-circular head portion 20.

The heel 16, from the standpoint of external appearance, is quite conventional and would be shaped to conform with the style of the shoe's upper 10. However, formed internally of the heel is a recess 22 having the same shape profile of the head 20 affixed to the shoe upper. Extending downwardly from the base of the recess 22 is a pin receiving bore 24 whose diameter is only slightly greater than the diameter of the pin 18. Also, the dimensions of the recess 22 are such that the head member 20 fits therein in a predetermined clearance fit. It can be seen, then, that the heel 16 may be fitted over the pin 18 and the head portion 20 to accurately and firmly secure the heel portion to the undersurface of the sole 12.

Figure 2:
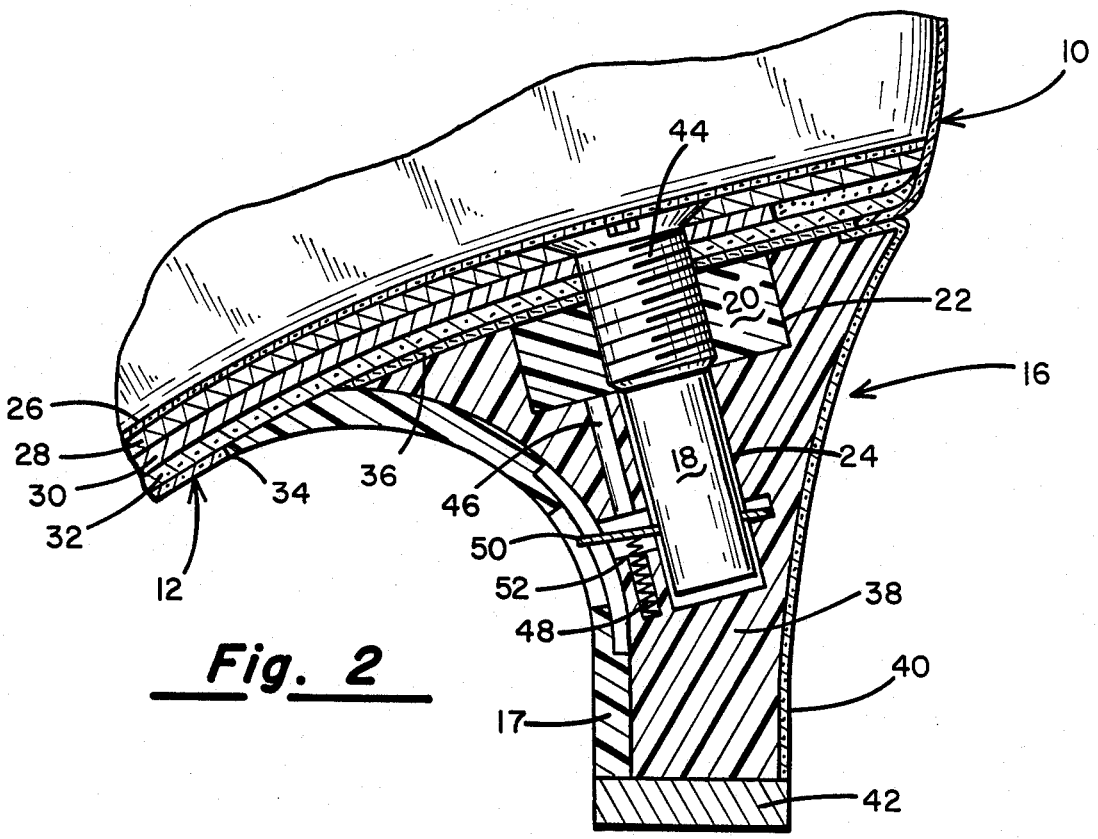
FIG. 2 is a cross-sectional view taken vertically along the sole and heel portion of a woman's shoe incorporating the present invention.

Referring next to FIG. 2, it can readily be seen how the heel member 16 is secured to the shoe upper 10. The shoe's sole 12 is seen to comprise a multi-layer assembly including a thin layer of leather 26 comprising the shoe's insole lining and underlaying the layer 26 is a further layer 28, which may typically be fabricated from cardboard or other material conventionally used in the manufacture of women's shoes. Below the layer 28 is typically located a steel arch plate and laminated to the underside of the arched plate 30 is a further layer of leather which, in FIG. 2, is identified by numeral 32. Completing the sole construction is the outer leather layer 12 extending from the forward edge 34 of the heel to the toe of the shoe (not shown). Extending rearward from the edge 34 to the counter-portion of the upper 10 is a fabric layer 36.

A typical shoe heel includes a molded plastic core piece 38 which is covered on its exterior side surfaces with leather, patent leather or a suitable natural or synthetic fabric, here identified by numeral 40. At the bottom of the heel 10 is a rubber, plastic, steel or leather layer 42 comprising the heel pad.

As is clearly illustrated in the cross-sectional view of FIG. 2, the pin 18 has an enlarged threaded screw portion 44 integrally formed therewith. The screw is counter-sunk in the layer 28 and the threads mate with corresponding threads of a bore formed through the head member 20. In this fashion, the head 20 and the pin 18 are firmly and rigidly secured to the undersurface of the sole 12.

As can also be seen in FIG. 2, the head member 20 fits into the recess 22 while the pin 18 extends downwardly into the bore 24 formed in the molded plastic core 38 of the heel.

To releasably lock the heel in place and to avoid inadvertent loss of the heel when being worn, the shoe construction of the present invention includes a latch mechanism which must be manipulated by hand to achieve release of the heel portion of the shoe from the upper. With continued reference to FIG. 2, it can be seen that a second, substantially smaller diameter bore 46 also extends downwardly into the core 38 in a generally parallel relation to the bore 24 in which pin 18 is made to fit. Dropped into the bore 46 and disposed at the lower end thereof is a compression spring 48. This spring cooperates with a strip member 50 which is preferably formed from spring steel and which extends transversely to the longitudinal axis of the bores 46 and 24 in a slot 52 formed laterally in the core 38 of the heel member. The strip 50 has an aperture therethrough just slightly greater in diameter than the outside diameter of the pin 18. Hence, when the biasing spring 48 urge the strip 50 out of perpendicular alignment with the pin 18, its edge surfaces dig into the pin 18 and prevent the heel from being pulled free of the pin. However, by merely depressing the latch 50 against the force of the spring 48 so as to bring the strip 50 into perpendicular alignment with the pin 18, the heel can be readily pulled free of the upper shoe portion 10.

Figure 3:
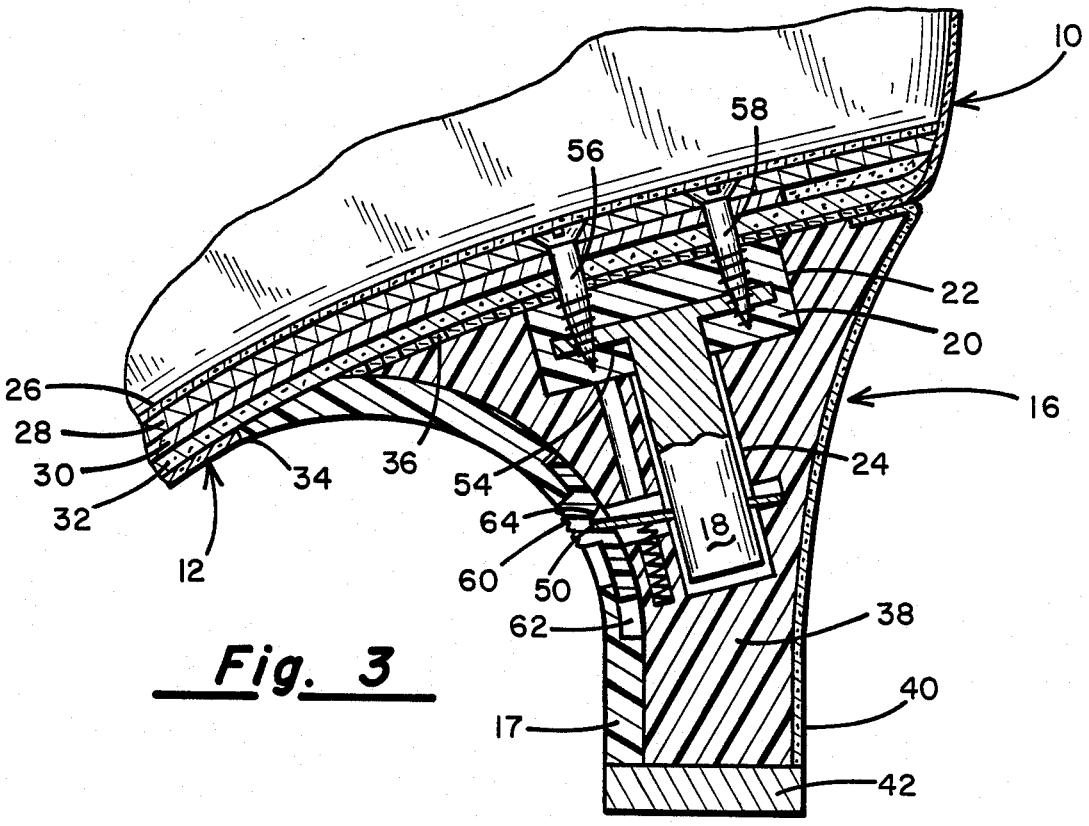
FIG. 3 is a further cross-sectional view taken vertically through a woman's shoe and illustrating a modification of the invention shown in FIG. 2.
Figure 8:
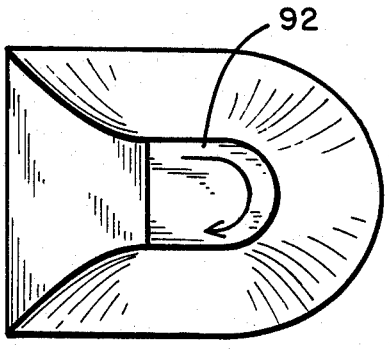
FIG. 8 is a view taken along the line 8—8 in FIG. 7.

Referring next to FIG. 3, an alternative method of securing the head member 20 and the pin 18 to the shoe's upper is illustrated. Here, the pin 18 has an integrally formed flange 54 on the upper end thereof and molded about the flange 54 is the plastic head member 20. Screws as at 56 and 58 underlying the lining 26 pass downward through the sole layers 28, 30, 32 and 36 and through drilled holes formed through the block comprising the head 20 and through similar holes drilled through the flange portion 54 of the pin 18. The leather lining 26, of course, hides the heads of screws 56 and 58 from view.

In FIG. 3, the locking mechanism is quite similar to the construction illustrated in FIG. 2 and already explained. However, in FIG. 3 there is shown an arcuate slide 60 which is preferably molded from plastic and which fits into a guide way 62 formed on the front face 17 on the heel 16. A notch 64 in the slide 60 receives the forward end of the strip 50 and the front surface thereof is preferably serated to facilitate frictional engagement thereof by the user's thumb or finger.

Figure 4:
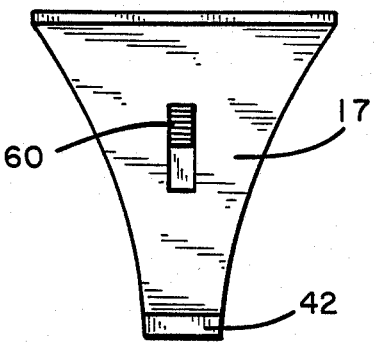
FIG. 4 is a front view of the heel portion of the shoe embodying the present invention.

FIG. 4 illustrates the front face 17 of the heel and the manner in which the slide 60 projects therethrough.

Figure 5:
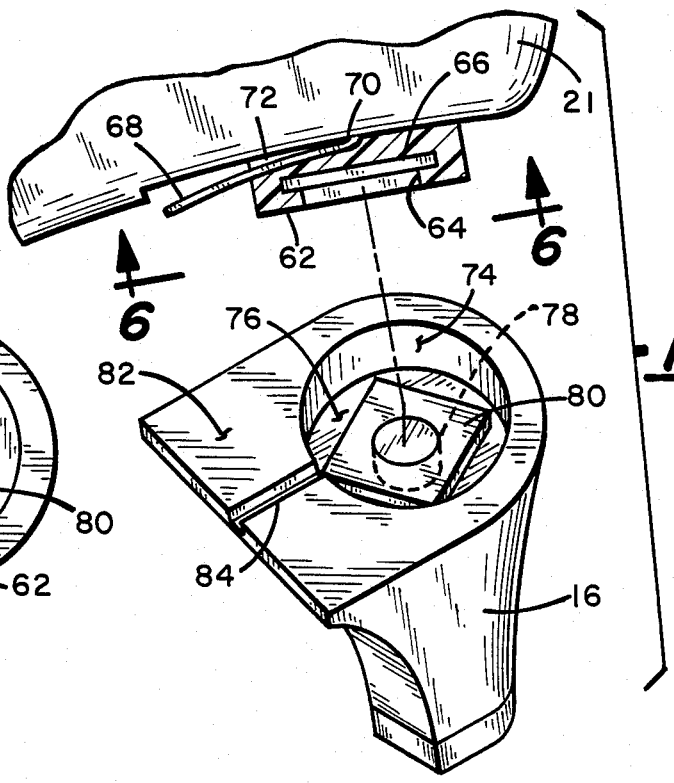
FIG. 5 illustrates an alternative arrangement for releasably attaching a heel member to a shoe upper.
Figure 6:
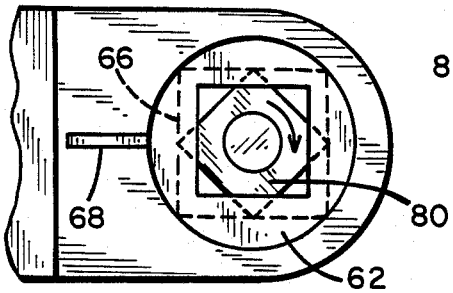
FIG. 6 is a view taken along the line 6—6 in FIG. 5.

FIGS. 5 and 6 illustrate an alternative method of securely latching the shoe heel 16 to the shoe upper 21. Here, a molded block 62, which is preferably fabricated from a suitable plastic is secured by appropriate means to the outer sole portion of the shoe upper 21. Extending inwardly from the bottom surface of the block 62 is a rectangular opening 64 which is preferably square and which leads to a rectangular recess 66 having a slightly larger side dimension than that of the rectangular opening 64. Furthermore, a spring latch 68 is fixedly attached at its inner end 70 to the block 62 and is cantilevered over the forward lip of the block 62. A slot 72 is cut into the surface of the block 62 to permit an upward force to lift the latch member 68 against the shoe sole.

The heel portion of FIG. 5 is identified by numeral 16 and seen to include a circular socket or recess 74 whose outside dimension is sized to receive the block 62 therein with a close tolerance fit. Projecting a slight distance upward from the base 76 of the recess 74 is a spacer 78 which is attached at its lower end to the core of the shoe heel 16. Resting atop the spacer 78 is a rectangular plate 80 whose dimensions are such that it is capable of being inserted through the rectangular aperture 64 formed in the block 62 when the heel is turned at approximately 45° to the longitudinal axis of the shoe. The height dimension of the pedestal 78 is such that the plate 80 will be positioned in alignment with the rectangular slot 66 when the upper heel surface 82 is adjacent the sole of the upper. Now, when the heel is rotated 45° so as to be appropriately aligned with the shoe upper, the rectangular plate 80 will have its corners contained within the slot 66 preventing the shoe heel from being pulled free of the block 62. At this point, the spring lever 68 will drop into a longitudinally aligned groove 84 formed in the surface 82 and will prevent the heel from being inadvertently rotated to the point where the plate 80 becomes aligned with the opening 64 to allow the heel to drop off.

Figure 7:
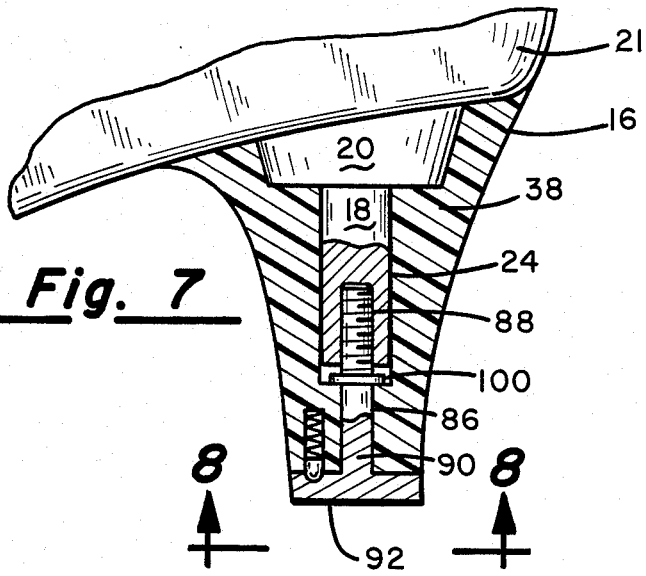
FIG. 7 is another alternative arrangement for securing a removable heel to a shoe upper.

FIG. 7 is a cross-sectional view of still a further embodiment of a shoe having a heel member which is readily removable and replaceable. As in the embodiment of FIG. 1, it includes a block member 20 having a pin 18 depending downwardly therefrom into a bore 24 formed interiorly of the shoe heel core 38. However, as shown in the view of FIG. 7, a further counterbore 86 is formed upwardly from the base of the heel 16 and the post 18 is drilled and tapped as at 88 to receive the threaded shaft 90 of a bolt whose head 92 comprises the heel plate.

Figure 9:
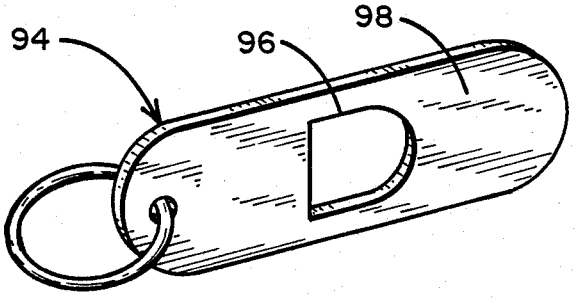
FIG. 9 illustrates a form of tool used with the embodiment of FIG. 7 to release the heel from the shoe upper.

With reference to FIG. 9, there is illustrated a convenient tool which may be used to readily remove the heel 16 from the upper 21 in the arrangement of FIG. 7. The tool is configured as a key chain 94 having an aperture 96 formed in the fob portion 98. The shape of the aperture 96 conforms to that of the heel plate 92 so that when it is fitted over the heel plate and rotated, the threaded shaft 90 can be removed from the post 18, allowing the heel 16 to be pulled free from the block 20.

A washer 100 resides in the base of the bore 24 and its central opening is of a size to prevent the threaded portion 88 of the shaft 90 to fit through it. Hence, the bolt-like member 90 remains with the heel 16 upon removal of the heel from the shoe upper.

Figure 10:
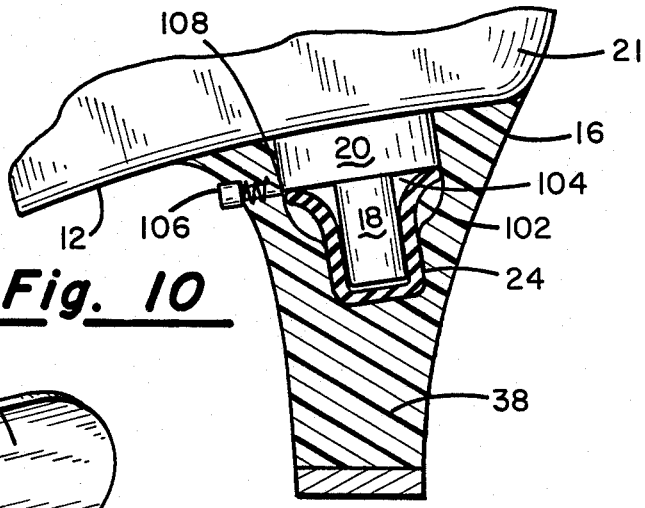
FIG. 10 is still another embodiment for securing a removable heel to a shoe upper.

In the embodiment of FIG. 10, a suction cup arrangement is used to create a vacuum for maintaining the heel in position on the underside of the shoe sole. More particularly, a cavity is formed in the core 38 of the heel member 16 for receiving a non-circular block 20 therein and the post 18 projects downwardly into an extension of this recess. Surrounding the post 18 is an elastomeric membrane 102 which fits into the bore 24 in the shoe core 38. When the heel is forced upward against the base of the sole of the upper, air is driven out of the annular zone 104 creating a vacuum condition therein. This vacuum force serves to retain the heel in position.

To readily release the heel 16 from the upper 21 in the embodiment of FIG. 10, a spring loaded push button 106 is provided which has a nose portion 108 interfacing with the intersection between the membrane 102 and the block 20. Depression of the push button 106 serves to break the vacuum allowing air to be introduced into the chamber 104 and releasing the suction hold on the heel.

Figure 11:
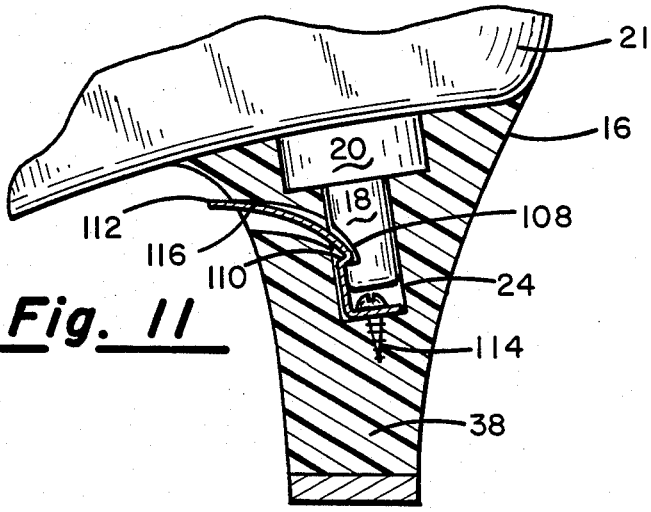
FIG. 11 is yet another arrangement for positively locking a shoe heel in place on a shoe upper.

In the embodiment of FIG. 11, the post 18 is notched as at 108 to receive a barb 110 formed in a leaf spring member 112. One end of the leaf spring extends outward from the heel's core at the front edge thereof while the other end of the leaf spring is fastened to the base of the cavity 18 by a screw fastener 114. A slotted area 116 is formed in the heel's core 38. As can be seen from the view of FIG. 11, when a downward force is applied to the exposed end of the leaf spring 112 to move the spring downward through the notch 116, the barb 110 on the leaf spring disengages from the notch 108 in the post 18, allowing the heel to be pulled free from the shoe upper 21.

Figure 13:
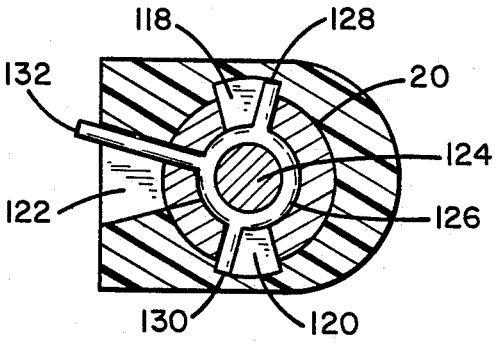
FIG. 13 is a cross-sectional view taken along the lines 13—13 in FIG. 12.
Figure 12:
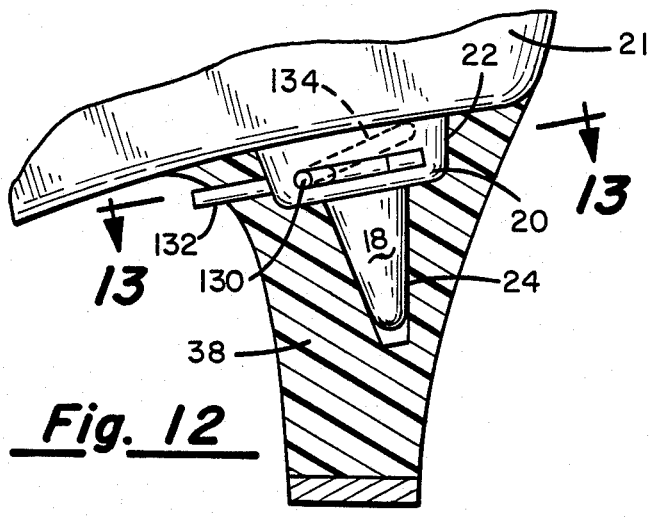
FIG. 12 is yet another embodiment for releasably locking a shoe heel to a shoe upper.

FIGS. 12 and 13 illustrate still a further way of releasably coupling a shoe heel to a shoe upper. In this arrangement, the block 20 secured to the bottom of the sole includes three horizontal slots 118, 120 and 122 (FIG. 13 ) and an upwardly extending pivot post 124. Surrounding the circular pivot 124 is a ring-shaped spider 126 having radially projecting latch fingers 128 and 130 and an actuating lever 132. Formed inwardly into the side wall of the socket 22 which receives the block member 20 is a spiral groove 134 into which the latch fingers 128 and 130 are received when the latch lever 132 is rotated counterclockwise from the position shown in FIG. 13. The engagement between the latch fingers 128 and 130 with the spiral grooves in the side wall of the block receiving socket 22 serves to force and hold the heel 16 tightly against the sole of the shoe.

Also, as can be seen in FIG. 12, it is not required that the post 18 be cylindrical. In the arrangement shown in FIG. 12, the post 18 is conical and arranged to cooperate with a corresponding conically shaped bore 24 formed into the core 38 of the heel.

Figure 15:
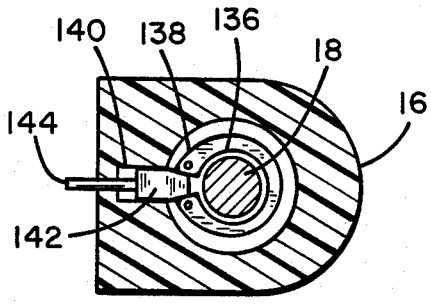
FIG. 15 is a cross-sectional view taken along the line 15—15 in FIG. 14.
Figure 14:
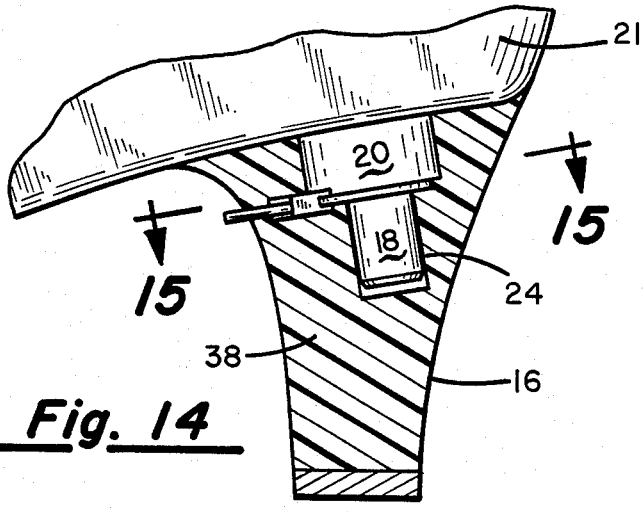
FIG. 14 illustrates yet a further mechanism for releasably latching a shoe heel to a shoe upper.

In FIGS. 14 and 15, still another alternative mechanism for positively latching a removable shoe heel 16 from a shoe upper 21 is disclosed. Again, the arrangement includes a non-circular block 20 of plastic or metal at the upper end of a pin or post 18. The block 20 is secured to the sole of the shoe in any suitable manner such as described in connection with earlier embodiments and the post 18 fits into a bore 24 drilled into the core 38 of the heel 16. At the point of intersection between the enlarged head 20 and the pin 18 there is formed an inwardly extending annular notch 136 into which may be fitted a C-ring clip 138. The C-ring is made from a spring material and in its relaxed state closely fits about the recess in the pin 18 but extends outward beyond the bore 24 into which the pin is fitted to block removal of the heel 16 from the pin. Fitted into a slot 140 formed in the heel's core 38 is a plunger 142 on the end of a pin 144 which projects laterally outwardly from the front edge of the heel 16. As can best be seen in FIG. 15, when an inward force is applied by the user's finger to the pin 144, the plunger cooperates with the C-ring 138 to spread its inside diameter to the point where it clears the notch 136 and post 18. This then allows the heel 16 to be easily slipped free of the block 20 and pin 18.

Figure 16:
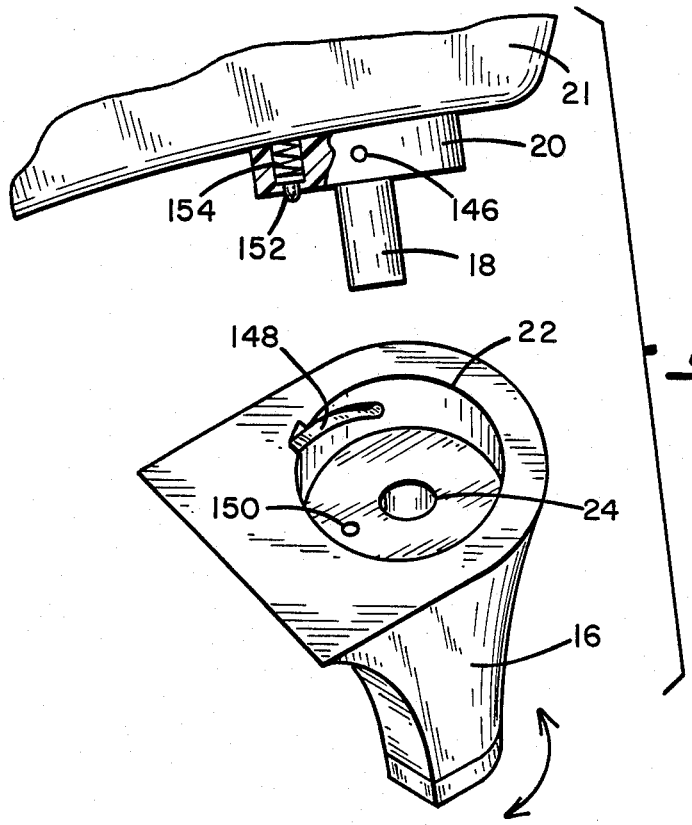
FIG. 16 is a further alternative embodiment of the present invention.

FIG. 16 depicts yet another possible arrangement for securing a replaceable shoe heel 16 to a shoe upper 21. In this arrangement, the head 20 is circular in profile and includes at least one but preferably two radially extending pins 146 which are intended to cooperate with laterally extending grooves 148 formed in the opposed side walls of the socket 22. In fitting the heel 16 to the upper, the pin 18 is inserted into the bore 24 formed internally of the heel 16 and when the pins 146 are aligned with the entrance to the grooves 148, the heel is rotated into proper alignment with the shoe upper and, in doing so, the pin 146 rides down the groove 148 caming the heel tightly against the sole of the shoe.

A detent dimple 150 is formed along the longitudinal axis of the shoe and is intended to cooperate with a spring-loaded detent ball 152 which is located in a bore 154 provided in the block 20. When the detent member 152 with its rounded end falls into the dimpled recess 150, it serves to inhibit rotation of the heel unless and until an appropriate torque is applied to dislodge the detent from its dimple.

Figure 17:
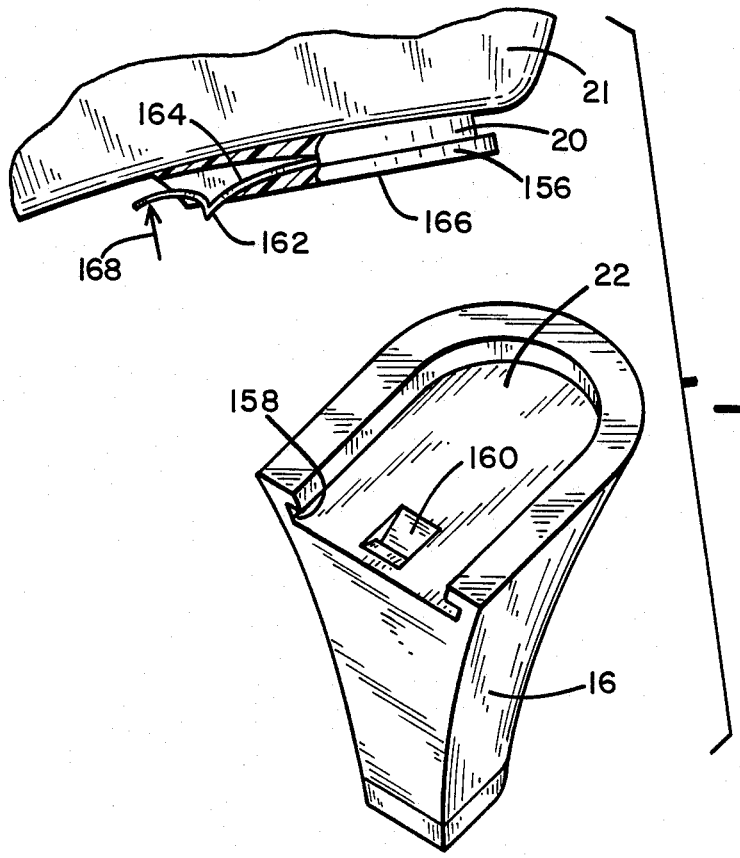
FIG. 17 illustrates a dove-tail coupling between a shoe heel and a shoe upper.

In the arrangement shown in FIG. 17, the block member 20 is generally U-shaped and includes an outwardly extending flange 156 which is intended to mate in dove-tailed relationship with a corresponding groove 158 formed in the socket 22 of the heel. Approximately centrally disposed toward the front edge of the shoe heel is a notch 160 for receiving the barb 162 of a leaf spring latch member 164 fitted into the block 20 and projecting downwardly from the bottom surface 166 thereof. When the heel 16 is aligned with the rear of the block 20 and then pushed forward, the barb 162 will fall into the notch 160 to lock the heel in its forward position. By pushing upward on the exposed end of the spring 154, as indicated by the arrow 168, the barb can be lifted free of the notch 160 allowing the heel 16 to again be pulled rearward and removed from the shoe upper 21.

Figure 18:
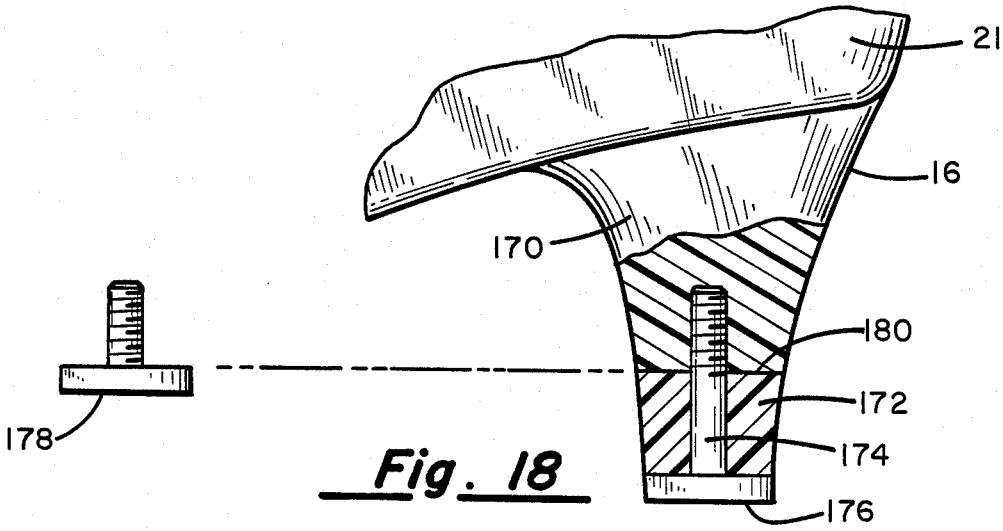
FIG. 18 illustrates a segmented heel construction where a portion of the shoe heel can be selectively removed to alter the shoe style.

FIG. 18 is a partially cross-sectioned, side view of a woman's shoe in which the style can be changed by adding or removing a heel segment. As is illustrated, the shoe upper 21 has a heel 16 fastened thereto, the heel comprising an upper segment 170 and a lower segment 172. The lower segment 172 is contoured to match the lines of the heel segment 170 and is attached thereto by a bolt 174 passing through a smooth bore in the lower heel segment and into a threaded bore in the upper heel segment 170. The bolt 174 may be metal or plastic and the flat, exposed head surface 176 acts as a tread or cleat. If a shorter, wider heel configuration is desired, the bolt 174 and heel segment 172 may be removed and a replacement bolt 178 may be screwed into the threaded bore, with the head thereof abutting the base 180 of the heel segment 170.

While a variety of latch mechanism have been illustrated herein, those skilled in the art may readily devise alternative devices for releasably securing the exchangeable heel or part of the heel in place on the bottom of the shoe's upper. For example, it is contemplated that a permanent magnet arrangement may be utilized to provide a requisite holding force to insure that the heel will stay in place during use but which can be overcome by pulling with sufficient force on the heel to overcome the magnetic attraction and to separate the heel from its pin and/or remove part of the heel.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. In a shoe of the type having an upper and a heel attached to said upper, the improvement comprising:

(a) a rigid pin member projecting outwardly and generally perpendicular to the sole portion of said upper proximate the location at which the heel joins the upper and said heel includes an internal bore for receiving said pin member;

(b) manually operable latch means for releasibly locking said pin member within said internal bore, said latch means comprising a strip member having an aperture extending through the thickness dimension thereof, said strip member fitted into a laterally extending recess in said heel with the portion thereof including said aperture being located within said bore in said heel, said pin member fitting through said aperture; and (c) means for normally biasing said strip member out of perpendicular alignment with said pin member to prevent relative movement of said heel relative to said upper, the application of a force overcoming said biasing means positioning said strip in perpendicular alignment with said pin member whereby said heel is removable from said pin.

2. The shoe as in claim 1 wherein said pin member includes an integrally formed threaded stem on one end thereof, said threaded stem passing through said sole portion into a nut.

3. The shoe as in claim 2 wherein said heel includes a recess for receiving said nut.

4. The shoe as in claim 1 and further including a slidable member affixed to said heel and engaging one end of said strip member for moving said strip member between the positions of perpendicular and non-perpendicular alignment to said pin.

5. The shoe as in claim 1 wherein said pin member is secured to said sole portion of said upper by at least one screw fastener.

6. The shoe as in claim 1 wherein said heel further includes a second bore parallel to said internal bore for receiving said biasing means.

7. The shoe as in claim 1 and further including a block affixed to said sole, said pin member projecting out from the exposed surface of said block and said heel including a socket for receiving said block.

* * * * *